US009068353B1

(12) United States Patent
Kovalchuk

(10) Patent No.: US 9,068,353 B1
(45) Date of Patent: Jun. 30, 2015

(54) DRY JOINT WALL CLADDING ATTACHMENT SYSTEM

(71) Applicant: Pavel Kovalchuk, Rancho Cordova, CA (US)

(72) Inventor: Pavel Kovalchuk, Rancho Cordova, CA (US)

( * ) Notice: Subject to any disclaimer, the term of this patent is extended or adjusted under 35 U.S.C. 154(b) by 0 days.

(21) Appl. No.: 13/998,830

(22) Filed: Dec. 11, 2013

(51) Int. Cl.
*E04B 2/00* (2006.01)
*E04F 13/12* (2006.01)

(52) U.S. Cl.
CPC .. *E04C 2/46* (2013.01); *E04F 13/12* (2013.01)

(58) Field of Classification Search
CPC ... E04F 13/0814; E04F 13/12; E04F 13/0889; E04F 13/0826; E04F 13/0812; E04F 13/081; E04F 13/2848; E04B 9/26; E04B 9/001; E04B 9/068; E04C 2/46; E04C 2/543
USPC ..... 52/508, 235, 474, 766, 762, 772, 775, 52/780, 781, 506.05, 506.08, 509, 510, 52/511, 512
See application file for complete search history.

(56) References Cited

U.S. PATENT DOCUMENTS 2,059,483 A * 11/1936 Parsons ..... 52/506.06
2,066,205 A * 12/1936 Keating ..... 52/506.09
2,789,321 A * 4/1957 Adams ..... 52/145
3,021,915 A * 2/1962 Kemp ..... 181/290
4,021,987 A * 5/1977 Schnebel et al. ..... 52/764
4,344,267 A * 8/1982 Sukolics ..... 52/475.1
4,452,029 A * 6/1984 Sukolics ..... 52/747.1
4,640,064 A * 2/1987 Goodworth, II ..... 52/506.08
4,667,579 A * 5/1987 Daw ..... 454/187
4,696,142 A * 9/1987 Mieyal et al. ..... 52/506.08
4,829,740 A * 5/1989 Hutchison ..... 52/475.1
4,833,839 A * 5/1989 Kurose ..... 52/39
4,833,858 A * 5/1989 Hutchison ..... 52/475.1
5,138,820 A * 8/1992 Pearce et al. ..... 52/656.1
5,263,292 A * 11/1993 Holland et al. ..... 52/235
5,579,624 A * 12/1996 Aeberhard ..... 52/586.2
5,644,878 A * 7/1997 Wehrmann ..... 52/287.1
5,809,729 A * 9/1998 Mitchell ..... 52/474
5,842,315 A * 12/1998 Lin ..... 52/309.9
5,996,301 A * 12/1999 Conterno ..... 52/563
6,035,598 A * 3/2000 Sukolics et al. ..... 52/506.08
6,101,777 A * 8/2000 Bodine et al. ..... 52/506.06
6,138,419 A * 10/2000 Sekiguchi et al. ..... 52/235
6,164,024 A * 12/2000 Konstantin ..... 52/200
6,205,733 B1 * 3/2001 LaLonde ..... 52/506.07
6,430,885 B1 * 8/2002 Ito ..... 52/483.1
6,470,629 B1 * 10/2002 Haddock ..... 52/24
6,745,527 B1 * 6/2004 Sherman et al. ..... 52/235

(Continued)

*Primary Examiner* — James Ference
(74) *Attorney, Agent, or Firm* — Clifford F. Rey

(57) ABSTRACT

A Dry Joint Wall Cladding Attachment System for mounting aluminum composite material (ACM) panels on a building substructure utilizing a non-progressive installation method which permits installation of such panels from any direction or location on the building structure. The present system and method of use provides structural elements including spring clips integrated with each ACM panel that enable a non-progressive panel installation sequence starting from any given location on a building facade even when some sections of the facade are not complete or otherwise not ready for progressive panel installation. Using a method of the present invention this is accomplished by the insertion of a reveal strip fabricated from a suitable material into a reveal cavity between adjacent panels for engagement with the integrated spring clips at any time after the panels are installed. The reveal strips are utilized to protect an underlying grid of mounting brackets and fasteners.

14 Claims, 14 Drawing Sheets

(56) References Cited

U.S. PATENT DOCUMENTS

| | | | | |
|---|---|---|---|---|
| 6,817,147 | B1 * | 11/2004 | MacDonald | 52/220.7 |
| 7,210,273 | B2 * | 5/2007 | Zahner, III | 52/302.3 |
| 7,472,521 | B2 * | 1/2009 | Bilge | 52/235 |
| 7,621,084 | B2 * | 11/2009 | Bilge | 52/235 |
| 7,726,083 | B2 * | 6/2010 | Wagner | 52/235 |
| 7,752,818 | B1 * | 7/2010 | Roegge et al. | 52/235 |
| 8,127,507 | B1 * | 3/2012 | Bilge | 52/235 |
| 8,166,716 | B2 * | 5/2012 | MacDonald et al. | 52/235 |
| 8,225,572 | B2 * | 7/2012 | Wallace | 52/512 |
| 8,256,181 | B2 * | 9/2012 | Voegele et al. | 52/543 |
| 8,307,607 | B2 * | 11/2012 | Conterno | 52/766 |
| 8,316,609 | B2 * | 11/2012 | Ben-Zvi | 52/582.1 |
| 8,713,878 | B2 * | 5/2014 | Dolby et al. | 52/396.03 |
| 8,739,483 | B1 * | 6/2014 | Bilge | 52/235 |
| 2001/0022058 | A1 * | 9/2001 | Conterno | 52/489.1 |
| 2002/0035811 | A1 * | 3/2002 | Heuel | 52/506.05 |
| 2002/0152704 | A1 * | 10/2002 | Thompson et al. | 52/506.06 |
| 2003/0192268 | A1 * | 10/2003 | Zaborowski | 52/220.6 |
| 2004/0134143 | A1 * | 7/2004 | Boyer | 52/235 |
| 2005/0102948 | A1 * | 5/2005 | Zahner, III | 52/582.2 |
| 2008/0010922 | A1 * | 1/2008 | Wagner | 52/235 |
| 2009/0049770 | A1 * | 2/2009 | Konstantin | 52/200 |
| 2009/0241444 | A1 * | 10/2009 | Griffiths | 52/235 |
| 2009/0241451 | A1 * | 10/2009 | Griffiths | 52/309.4 |
| 2010/0186343 | A1 * | 7/2010 | MacDonald et al. | 52/747.1 |
| 2010/0263314 | A1 * | 10/2010 | MacDonald et al. | 52/506.05 |
| 2011/0067338 | A1 * | 3/2011 | Wallace | 52/512 |
| 2012/0085042 | A1 * | 4/2012 | MacDonald et al. | 52/173.3 |
| 2012/0186170 | A1 * | 7/2012 | MacDonald et al. | 52/173.3 |
| 2012/0198788 | A1 * | 8/2012 | MacDonald et al. | 52/747.1 |
| 2014/0202094 | A1 * | 7/2014 | Bilge | 52/235 |

* cited by examiner

DRY JOINT WALL CLADDING ATTACHMENT SYSTEM

BACKGROUND OF INVENTION

Field of Invention

The present invention relates to building construction and, more particularly, to a mounting system for building facades formed of sheet metal panels such as aluminum composite material (ACM) and other suitable building materials, which are installed on an underlying mounting grid applied to a building structure that enables convenient installation, repair or replacement of individual panels.

The use of aluminum composite material (ACM) panel systems for exterior building facades are known in the prior art. Such ACM panels are typically made from two sheets of aluminum material bonded to a thermoplastic core. ACM panels are strong and lightweight and can be applied to new building facings or during remodeling of an existing structure. ACM panels can be fabricated to conform to very complex and intricate building wall designs.

ACM wall cladding systems are typically of two types, namely, Wet Joint Systems comprised of caulked or rubber gasket joints or, alternatively, Dry Joint Systems, which do not use caulking or rubber gaskets. Wet Joint Systems rely upon adhesive or caulking to seal the wall panels from weather elements. However, under exposure to cold, heat and moisture such Wet Joint Systems can fail. To remedy this situation new caulking must be reapplied to protect the building and to create watertight joints. Dry Joint Systems are comprised of assembled wall panels that do not have water tight joints and rely on weather barriers (i.e. underlayment materials) to protect the building structure from air and water intrusions.

Both prior art Wet Joint and Dry Joint wall cladding systems typically include individual wall panels which are mounted on extruded aluminum frame members attached to the underlying building substructure with fasteners in a grid-like pattern. During the installation process a filler strip of ACM material is typically installed in the gap or so-called reveal between adjacent wall panels. Most wall cladding systems require filler strips to be installed into a slot formed in the extruded aluminum frame members in a continuous or so-called "progressive" manner (i.e. as each wall panel is installed) before installation of the next adjacent wall panel. However, such a "progressive" installation method requires complete removal of installed panels in reverse order to replace a ground level panel that has been damaged, for example, by vehicular impact, other accidental damage or vandalism.

Thus, the present Dry Joint Wall Cladding Attachment System has been developed to provide a "non-progressive" installation system and method of use which includes novel structural elements and offers additional advantages over the prior art.

DESCRIPTION OF RELATED PRIOR ART

U.S. Pat. No. 4,021,987, granted May 10, 1977, to Fritz Schnebel, et al., discloses the use of tie beams and girders for use in retaining facades constructed from prefabricated elements. A facade is mounted thereon simply by attaching a retaining strip and interposing packing elements, whereupon the tie beams and girders of aluminum are capable of absorbing horizontal or vertical displacements of the facade within a specific tolerance range.

U.S. Pat. No. 4,452,029, granted Jan. 5, 1984, to Ronald D. Sukolics, provides a clip having an inward force or pressure, wherein panel interlocks, which are ridges running longitudinally along the length of side, press against the panel member, having grooves on the inner sides of the turned down edges. (Column 2, lines 41-48) The citation further states, at Column 2, line 46: "An insert strip 26 is located between turned down edges 22 such that grooves 24 are maintained in cooperation with interlocks 18 and 20."

U.S. Pat. No. 5,842,315, granted Dec. 1, 1998, to William H. Porter, discloses an insulated structural panel with a flat insulating core, first and second outer facings attached to opposed lateral surfaces of the insulating core, with a liner, elongated metal strip disposed between and attached to the insulating core and the first outer facing to the extended length of the panel for increasing the bending strength of the panel.

U.S. Pat. No. 6,470,629, granted Oct. 29, 2002, to R. M. Haddock, discloses an apparatus for securing members to a surface. The apparatus includes a mounting clamp, a mounting adaptor, a panel support member and a fastener. The panel support member and the mounting adaptor are slidably interconnected to one another. The mounting adaptor is fixedly interconnected to the mounting clamps using the fastener. The mounting adaptor may also include an area of reduced strength to permit the controlled failure of the apparatus in response to excess loading. The panel support member may be adapted to receive a panel. When installed on a surface, the apparatus obscures the view of mounting devices or equipment that may also be secured to the surface.

U.S. Pat. No. 6,817,147, granted Nov. 16, 2004, to Douglas B. MacDonald, discloses a clip for panel trim that is a U-shaped flexible member defining a base and extending arms with end portions extending inwardly for insertion in openings of a partition frame member to retain the clip on the frame so that the base is separated from the frame for routing of utility lines on the partition frame member and through the clip.

U.S. Pat. No. 8,347,569, granted Jan. 8, 2013, to J. Andrew McIntyre discloses a self-leveling structural element in a non-progressive ACM attachment system, a U-shaped retentive clip having a base and two upwardly extending arms that are forced apart by the installation of a self-drilling screw, the retentive clip with screw coacting with an extruded frame to mount and retain a plurality of aluminum composite material (ACM) panels in a coplanar manner for a non-progressive system that enables removal of individual panels for replacement or repair. Although this ACM mounting system provides for non-progressive installation of panels, a plurality of fasteners must be separately installed in the reveal cavity between adjacent panels to secure each panel to the underlying frame assembly necessitating additional steps in the installation/removal process.

While these devices fulfill their respective, particular objectives and requirements, the aforementioned patents do not disclose the novel features of the present Dry Joint Wall Cladding Attachment System. The present system provides structural elements including novel spring retaining clips that allow the ACM panels to be installed in a non-progressive manner, that is, such panels can be started from any direction on the building facade. The ability to install ACM panels from any direction allows a continual progress of installation, even when sections of the building substrate are not ready or other job conditions do not allow for panel installation.

SUMMARY OF THE INVENTION

Accordingly, the present invention is a Dry Joint Wall Cladding Attachment System for mounting aluminum composite material (ACM) panels or other similar panels on a building structure utilizing a non-progressive installation method, which allows installation of such panels from any direction on the building structure and convenient removal of individual panels.

The present system and method of use provides structural elements including novel spring clips integrated with each ACM panel that allow a non-progressive installation sequence starting from any given location on a wall facing even when some sections of the wall facing are not complete or otherwise ready for progressive panel installation. Using the present method this is accomplished by the insertion of a reveal strip fabricated from ACM material or other suitable material into the so-called reveal cavity between adjacent panels for engagement with the integrated spring clips at any time after the panels are installed on the wall facing. The reveal strip covers the underlying mounting hardware and provides convenient access for panel repair/removal. The installation of the reveal strip is done by manually inserting it into the reveal cavity thereby compressing the integrated spring clips installed on each panel. Once the reveal strip is properly positioned inside the reveal cavity, the spring clips return to a relaxed condition locking the reveal strip in place without the need for additional fasteners to complete the panel installation.

Each panel defines a drainable compartment that limits water penetration and also provides for air infiltration to prevent moisture build up under adverse weather conditions. Moisture penetration into the present system is dependent on a properly selected water barrier that is appropriate for the geographic area.

There has thus been outlined, rather broadly, the important features of the invention in order that the detailed description thereof that follows may be better understood, and in order that the present contribution to the art may be better appreciated. There are additional features of the invention that will be described hereinafter and which will form the subject matter of the claims appended hereto.

Those skilled in the art will appreciate that the conception upon which this disclosure is based may readily be utilized as a basis for the designing of other structures, methods, and systems for carrying out the purposes of the present invention. It is important, therefore, that the claims be regarded as including such equivalent constructions insofar as they do not depart from the spirit and scope of the present invention.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention.

Prior to describing the novel features of the present invention in detail, it may be beneficial to briefly review the structure and installation methods of wall cladding systems of the prior art in order that the description of the present invention that follows may be better understood and that the present contribution to the art may be better appreciated.

Figure 1:
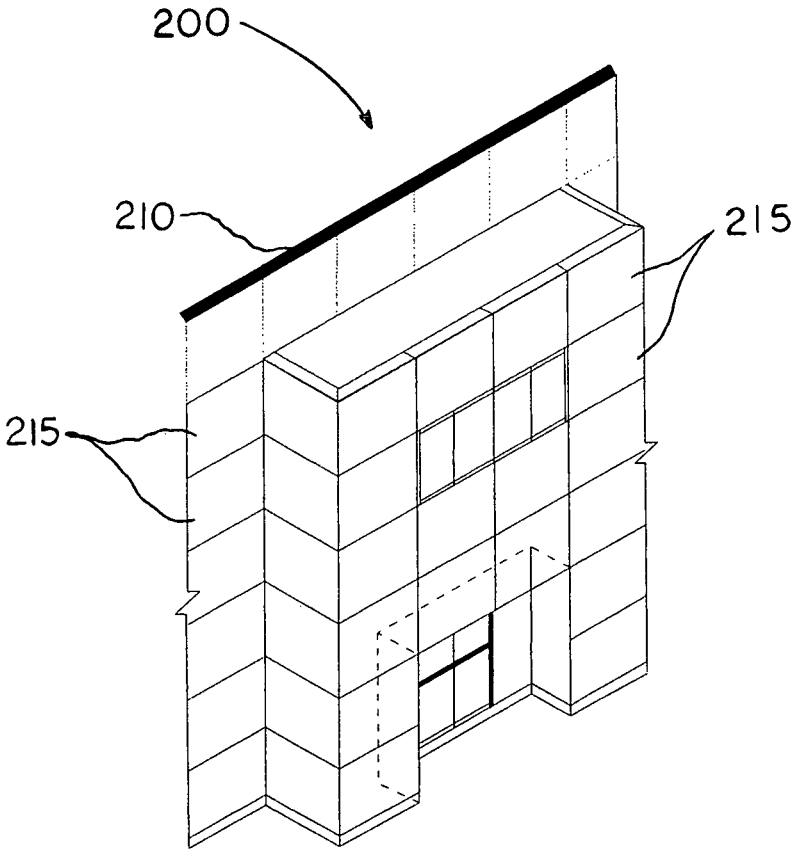
FIG. 1 PRIOR ART
FIG. 1 is a perspective view of section of a building façade showing a prior art Wall Cladding System installed thereon and is labeled Prior Art.

With further reference to the drawings there is shown therein an Aluminum Composite Material (ACM) Wall Cladding System of the prior art, indicated generally at 200 and illustrated in FIG. 1. It is reiterated that such ACM Wall Cladding Systems are typically of two types, namely, Wet Joint Systems comprised of caulked or rubber gasket joints or, alternatively, Dry Joint Systems which do not use caulking or rubber gaskets. Either type of Wall Cladding system may utilize an underlying water barrier (not shown) comprised of an engineered plastic sheet or other suitable material known in the industry.

Figure 3:
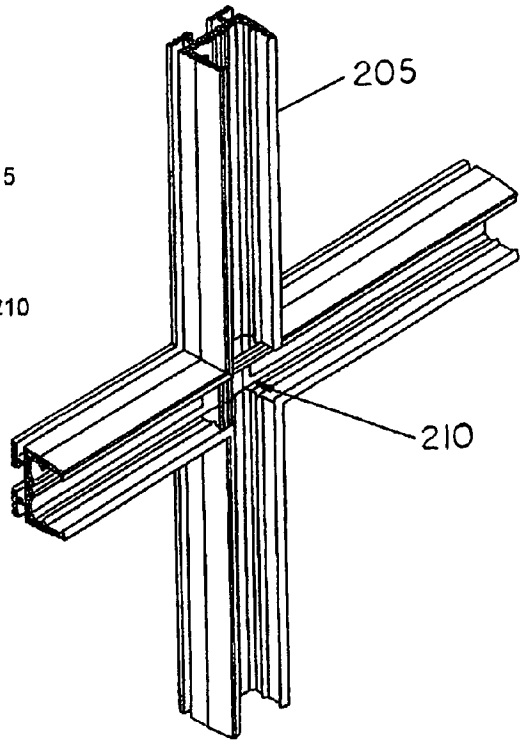
FIG. 3 PRIOR ART
FIG. 3 is a perspective view of a typical welded intersection of the horizontal and vertical frame members comprising a frame assembly whereon ACM panels are retained and is labeled Prior Art.
Figure 2:
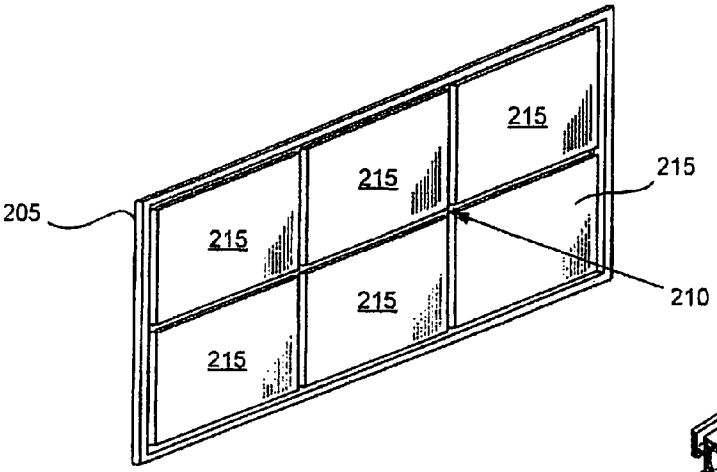
FIG. 2 PRIOR ART
FIG. 2 is a perspective view of an enlarged section of the prior art Wall Cladding System of FIG. 1 comprised of a plurality of ACM panels collectively held in place by a frame assembly and is labeled Prior Art.
Figure 4:
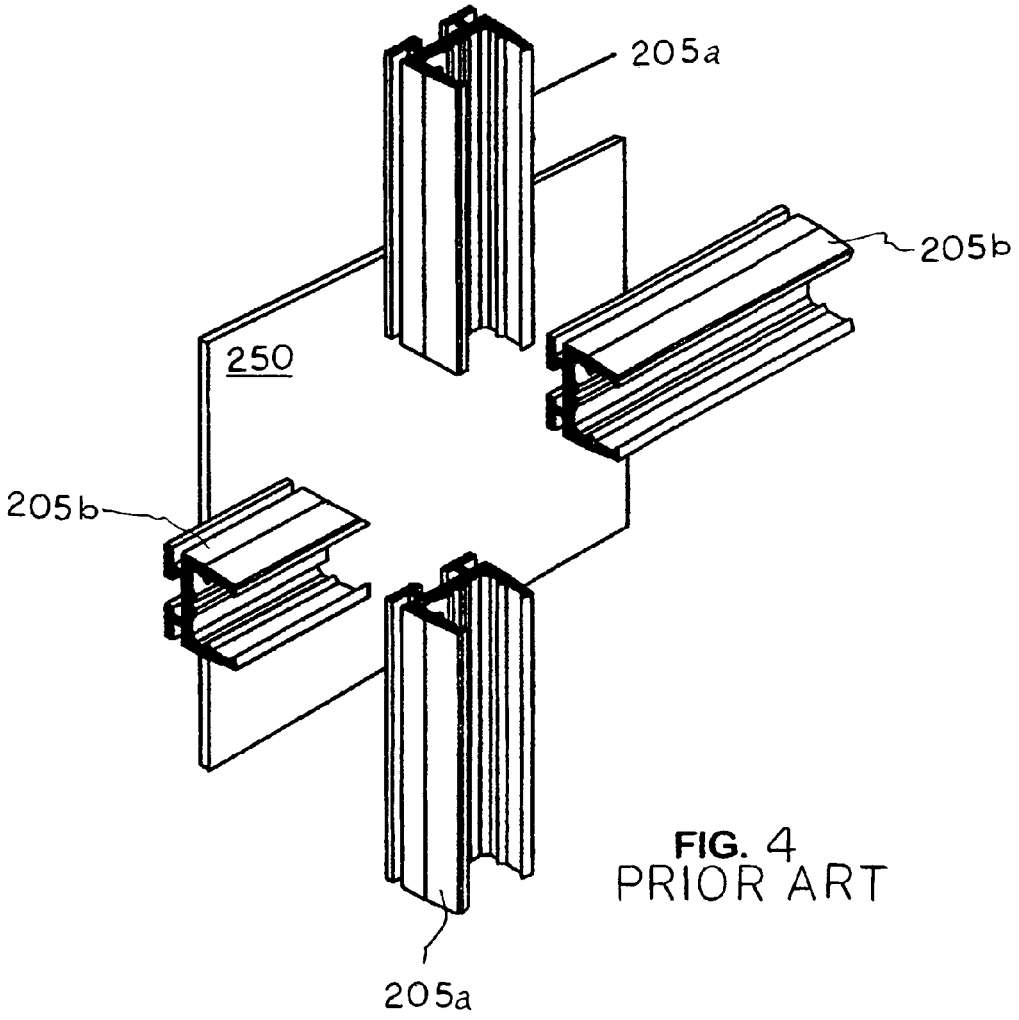
FIG. 4 PRIOR ART
FIG. 4 is an exploded perspective view of the typical welded intersection of the horizontal and vertical frame members shown in FIG. 3 and is labeled Prior Art.

Both such prior art Wet Joint and Dry Joint Wall Cladding Systems include individual wall panels 215 (FIG. 2) which are mounted on an extruded aluminum frame assembly, indicated generally at 205, as shown in FIG. 3, and attached to an underlying building structure 250 (FIG. 4) with fasteners. Frame assembly 205 is comprised of a plurality of vertical frame members 205*a* and horizontal frame members 205*b* joined at an intersection 210 and arranged in perpendicular relation in a rectangular grid pattern as more clearly shown in exploded view in FIG. 4. The collective cavities defined by the frame assembly 205 are configured to receive a plurality of panels 215, wherein the side members of the panels are inserted into the frame assembly 205 such that each adjacent panel 215 will lie in a coplanar manner.

Figure 5:
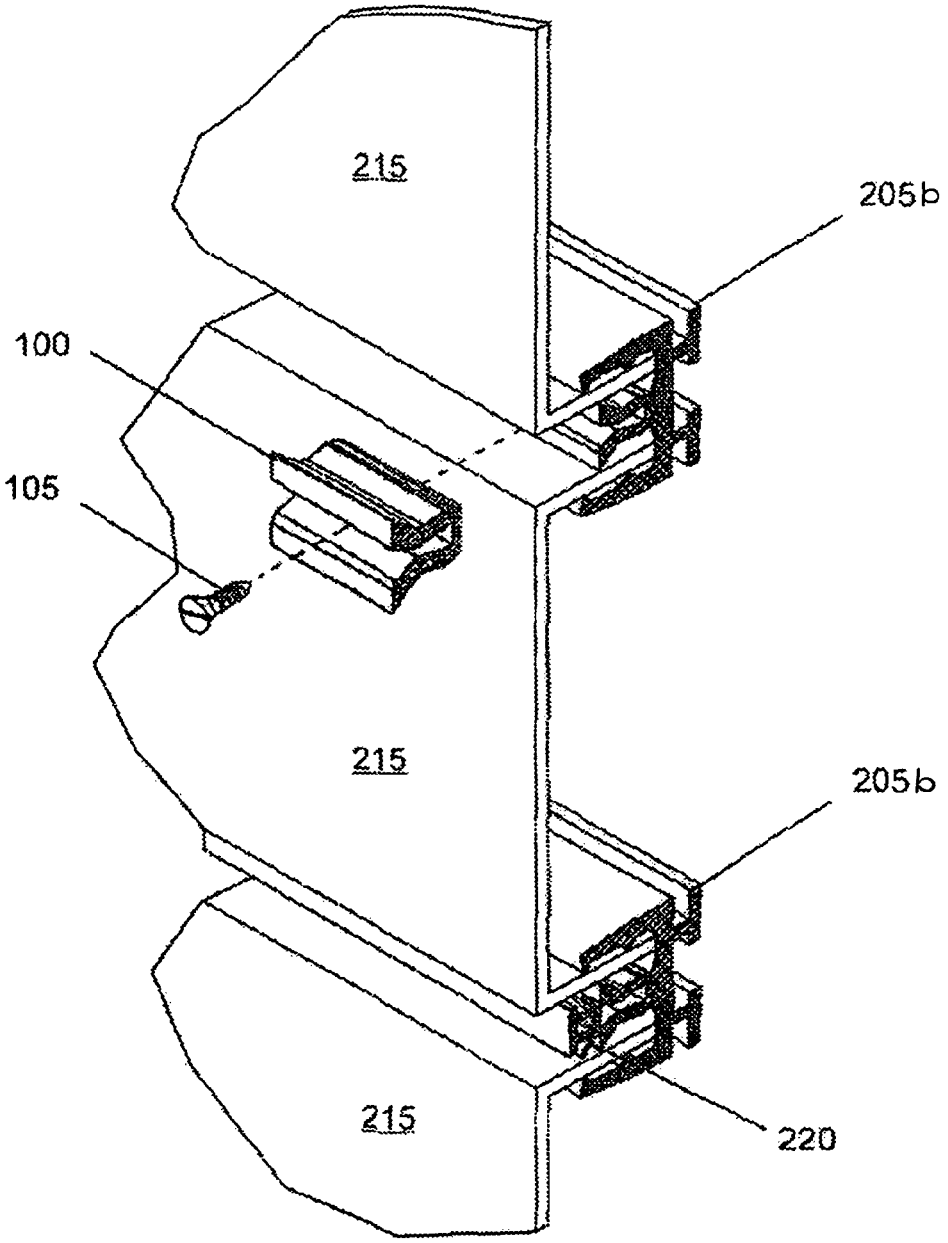
FIG. 5 PRIOR ART
FIG. 5 is an exploded perspective view of the ACM panels inserted into the extruded frame members and clamped by prior art panel-retaining clips and is labeled Prior Art.
Figure 6:
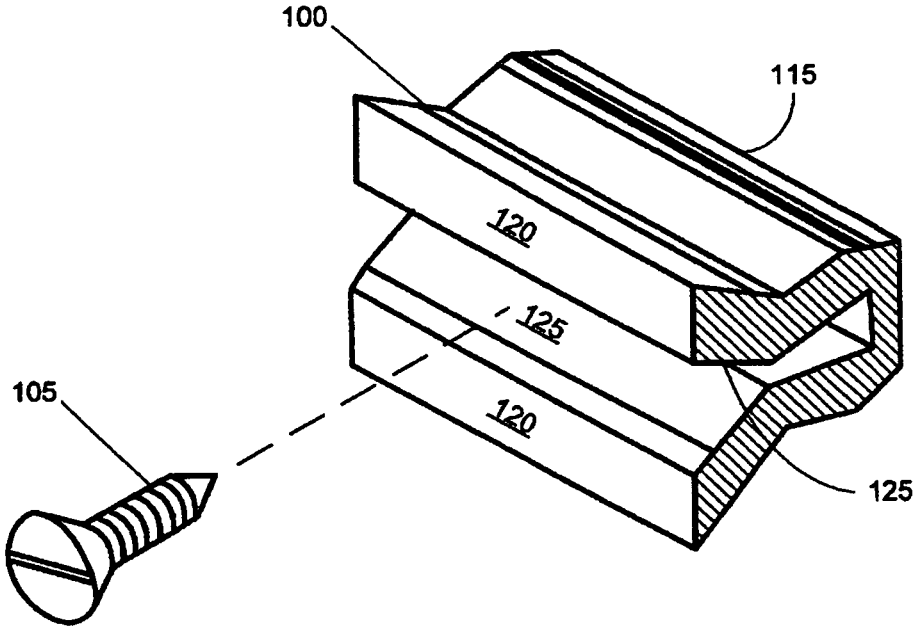
FIG. 6 PRIOR ART
FIG. 6 is a perspective view of a prior art panel-retaining clip with its associated self-drilling mounting screw and is labeled Prior Art.

Referring now to FIGS. 5 and 6, such prior art Wall Cladding Systems typically require some type of deformable clip 100 comprising a structural element for retaining such panels 215 to a frame member assembly 205. Such prior art clips 100 are typically formed into suitable extruded lengths for ease in handling. The extruded lengths are then sheared into a plurality of clips 100 of shorter lengths. Orthogonal to the base 115 of the prior art clip 100 illustrated are two arms 120, each having beveled planes 125 on inward facing surfaces thereof (FIG. 6).

In the prior art a self-drilling screw 105 is typically used to secure the clip 100 during the installation by passing through a hole (not shown) in the base 115 of the clip. The screw 105 is typically a flat head self-drilling screw having an included angle that matches the included angle formed by the beveled planes 125 of the clip 100 shown in FIG. 6. A fastener hole (not shown) is formed through the base 115 for removably fixing the clip 100 to its supporting frame 205, via mounting screws 105. After the panels 215 are seated into the frame 205 and retained by the clips 100, a gasket 220 is inserted into the slotted opening between adjacent panels 215 to complete the installation of the Wall Cladding System 200 as shown in FIG. 5.

In many prior art Wall Cladding Systems the removal of a single panel 215 for repair or replacement requires the removal of an entire section of the ACM facing because the panels 215 are interconnected. The use of the deformable clip 100 of the type disclosed in U.S. Pat. No. 8,347,569 to J. Andrew McIntyre, for example, provides a Wall Cladding System 200 wherein each individual panel is removable for replacement or repair. However, the above-referenced non-progressive system of U.S. Pat. No. 8,347,569 does not provide the novel structural features and technical advantages of the present invention, which will now be disclosed in detail.

Figure 7:
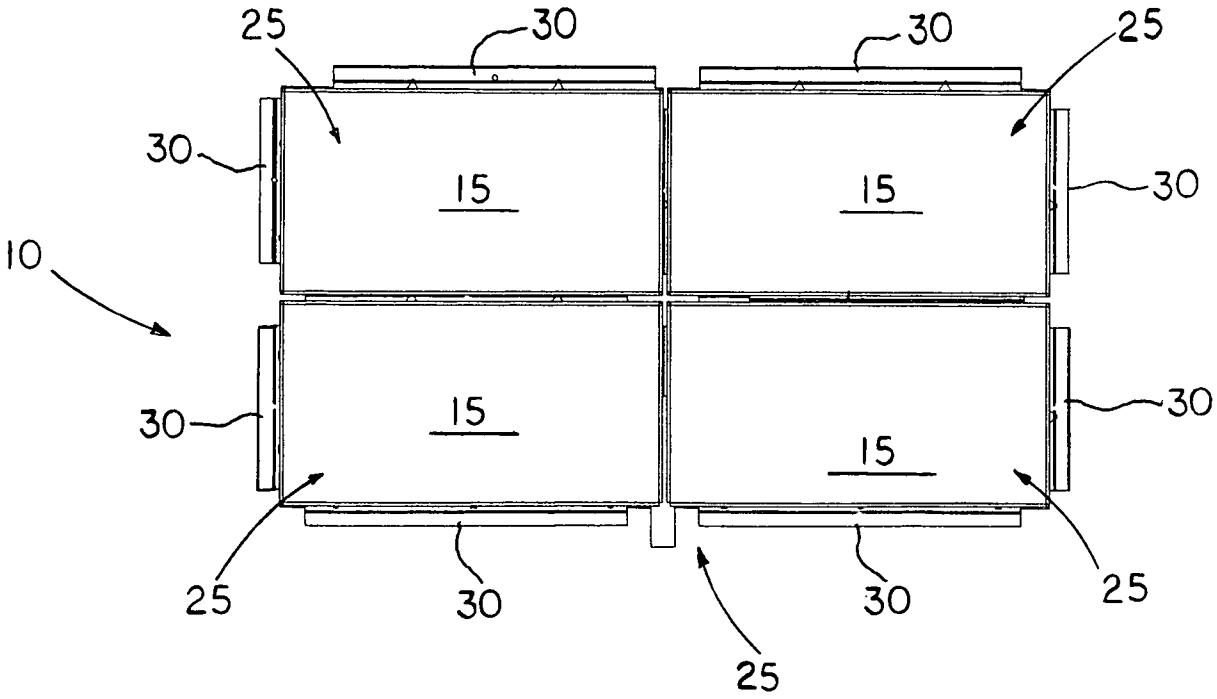
FIG. 7 is a front elevation view showing a section of the Dry Joint Wall Cladding Attachment System of the present invention including an array of ACM panel assemblies mounted on an underlying grid layout.

Referring now to FIG. 7 there is shown therein a Dry Joint Wall Cladding Attachment System, indicated generally at 10, for mounting an array of aluminum composite material (ACM) panel assemblies, indicated generally at 25, each including an ACM panel 15 and a panel frame subassembly, indicated generally at 35 (FIG. 9), which is mechanically attached by appropriate fasteners about the periphery of each panel 15 in advance of installation. As in the prior art systems described hereinabove, an optional moisture protection barrier 75 (FIG. 15) of an engineered plastic sheet or other suitable water barrier may be employed with the present system 10 and applied to the underlying building substructure in advance of installing the present system if appropriate for the geographic area.

The present wall mounting grid comprises a plurality of extruded aluminum, panel mounting strips or brackets 30 of various lengths which are mounted to an underlying building substructure 50 (FIG. 13) with appropriate fasteners such as screws 32 (FIG. 13) at predetermined locations in a pattern designed to receive panel assemblies 25 during installation. The layout of the mounting brackets 30 is correlated with the dimensions of the individual panel assemblies 25 to be installed.

Figure 8A:
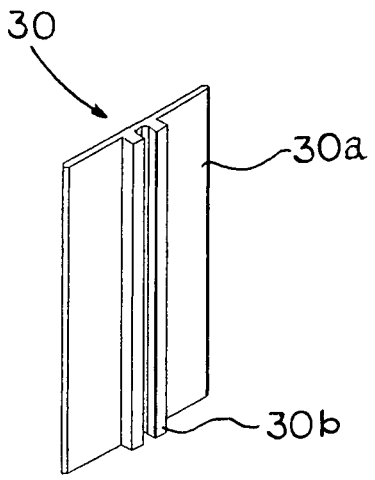
FIG. 8A is a perspective view of a section of a panel mounting bracket of the present system.
Figure 8B:
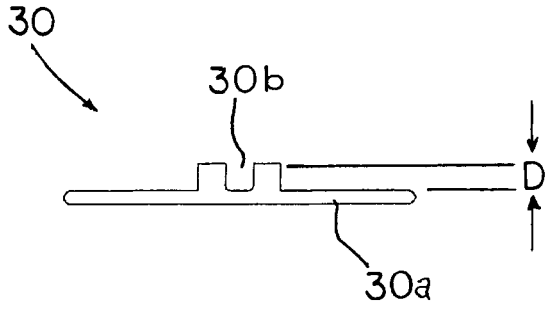
FIG. 8B is a cross-sectional view of the panel mounting bracket of FIG. 8A.
Figure 13:
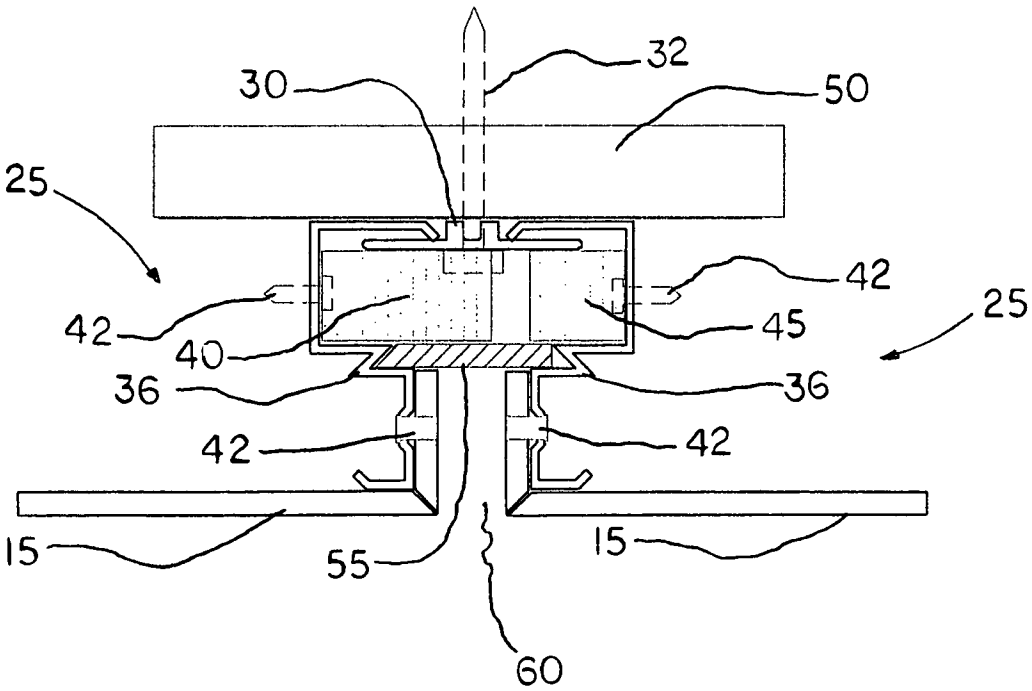
FIG. 13 is a cross-sectional view taken through the juncture of two adjoining panel assemblies of the present system attached to a building substructure and secured with a fastener.

As shown in FIGS. 8A-8B brackets 30 are configured as a flattened member 30*a* with an integral channel portion 30*b* extending along the entire length thereof, which functions as a spacer to stand the brackets 30 off the building substructure to a dimension "D" to permit sufficient clearance for engagement with the panel frame subassembly 35 (FIG. 9) in order to hold the panel assemblies 25 to the wall facing in a coplanar manner as shown in FIG. 13.

Figure 9:
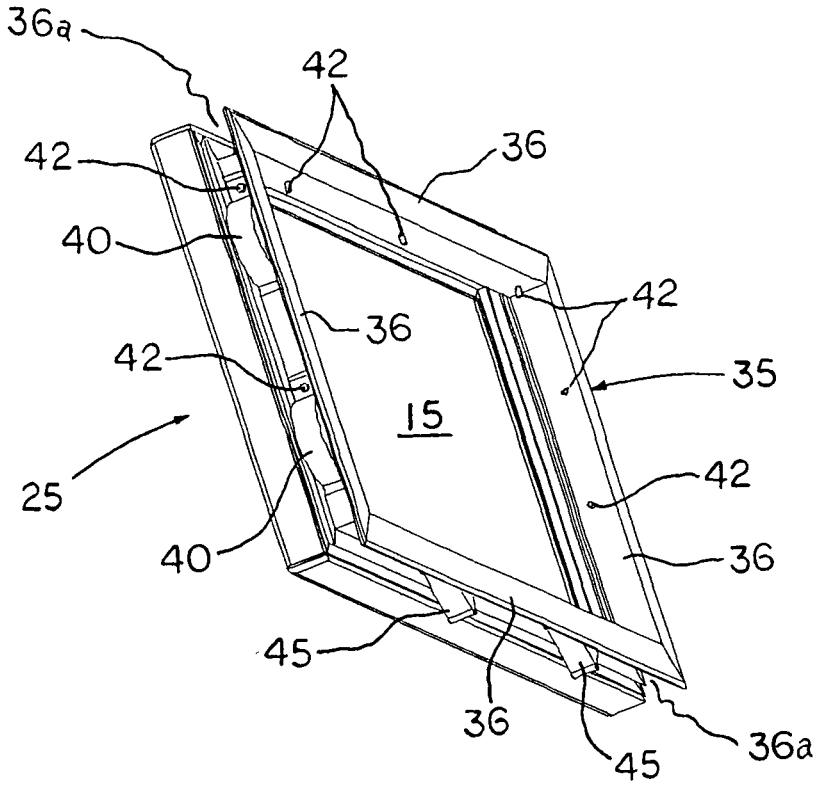
FIG. 9 is a rear perspective view of an ACM panel assembly for use with the present system.
Figure 10A:
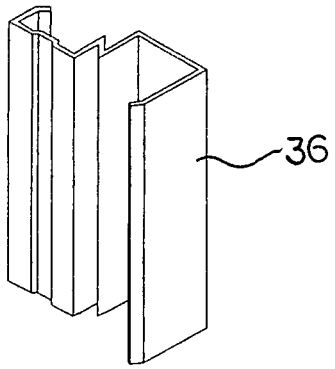
FIG. 10A is a perspective view of a section of a panel frame side member utilized to construct each panel frame subassembly of the present system.
Figure 10B:
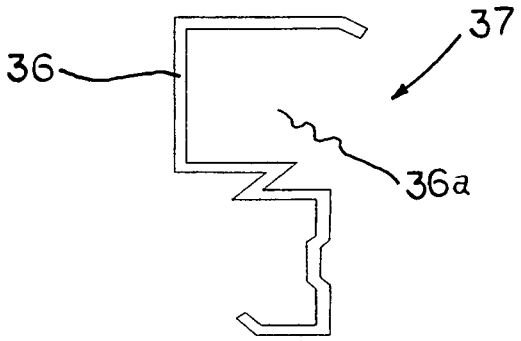
FIG. 10B is a cross-sectional view of a section of the panel frame side member shown in FIG. 10A illustrating the cross-sectional profile thereof.

Referring to FIGS. 10A-10B each panel frame subassembly is constructed of individual extruded side members 36 (FIG. 10A) of a predetermined length and design having a cross-sectional profile as indicated generally at 37 (FIG. 10B). Side members 36 are configured to engage brackets 30 during installation and to receive spring clips 40, 45 attached thereto as shown more clearly in FIG. 9.

Figure 11A:
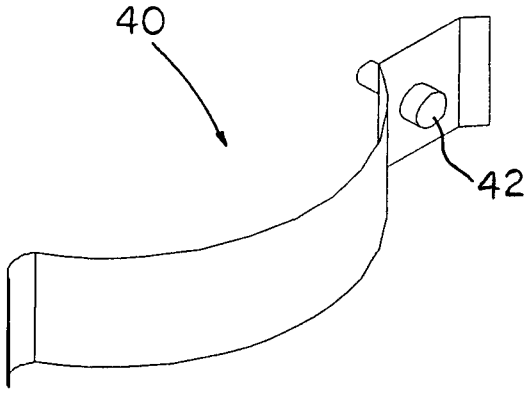
FIG. 11A is a perspective view of a curved spring clip shown in a relaxed condition and utilized in each ACM panel assembly of the present system.
Figure 12A:
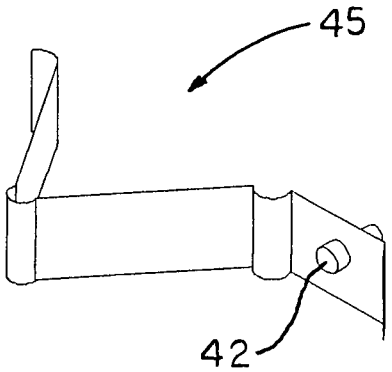
FIG. 12A is a perspective view of an angular spring clip shown in a relaxed condition and utilized in each ACM panel assembly of the present system.

In a preferred construction side members 36 of a predetermined length are fabricated to include mitered corners at any desired angle, which are mechanically attached by suitable fasteners to form a rectangular frame subassembly 35 as illustrated in FIG. 9. A plurality of spring clips 40, 45 (FIGS. 11A and 12A) are installed within a channel feature as at 36*a* formed along the length of each side member 36 using suitable fasteners such as rivets 42 in the arrangement shown in FIG. 9.

FIG. 13 shows a cross-section view of a typical panel assembly 25 installation taken through a dry joint at the juncture of two adjoining panel assemblies 25 of the present system. It will be appreciated that panel assemblies 25 are attached to a building substructure 50 by installing mounting clips 30 (FIGS. 8A-8B), which are secured to the substructure with fasteners such as screws 32. It can be seen that the side member 36 of each panel assembly 25 engage the mounting clips 30 as illustrated to secure the panel assemblies in coplanar relation on the building substructure 50.

Figure 14A:
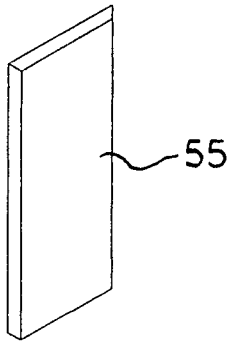
FIG. 14A is a perspective view of a section of an ACM filler strip for insertion in the reveal cavity between adjoining ACM panel assemblies of the present system.
Figure 14B:
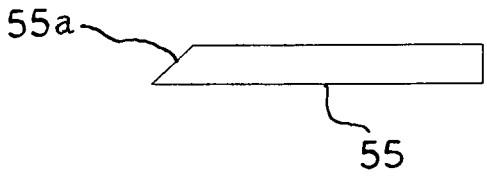
FIG. 14B is a cross-sectional view of a section of a reveal strip of FIG. 14A showing a beveled edge formed thereon.

Still referring to FIG. 13 it will be appreciated that a reveal strip 55 is captured in the reveal cavity as at 60 between the adjoining panel assemblies 25 and secured in place with the spring clips 40, 45. As shown in FIGS. 14A-14B reveal strip 55 is fabricated as an elongated rectangular member (FIG. 14A) into suitable lengths for ease in handling, which are then sheared into a plurality of strips 55 of shorter lengths. In a preferred embodiment reveal strips 55 are constructed from the same ACM materials as panels 15. However, other alternative materials including engineered plastics are suitable for this application.

Reveal strips 55 include a beveled edge 55*a* formed along one lateral edge extending along the entire length thereof. Beveled edge 55*a* functions to guide reveal strips 55 during insertion into the reveal cavity 60 wherein strips 55 are locked into position as hereinafter explained in further detail.

Figure 15:
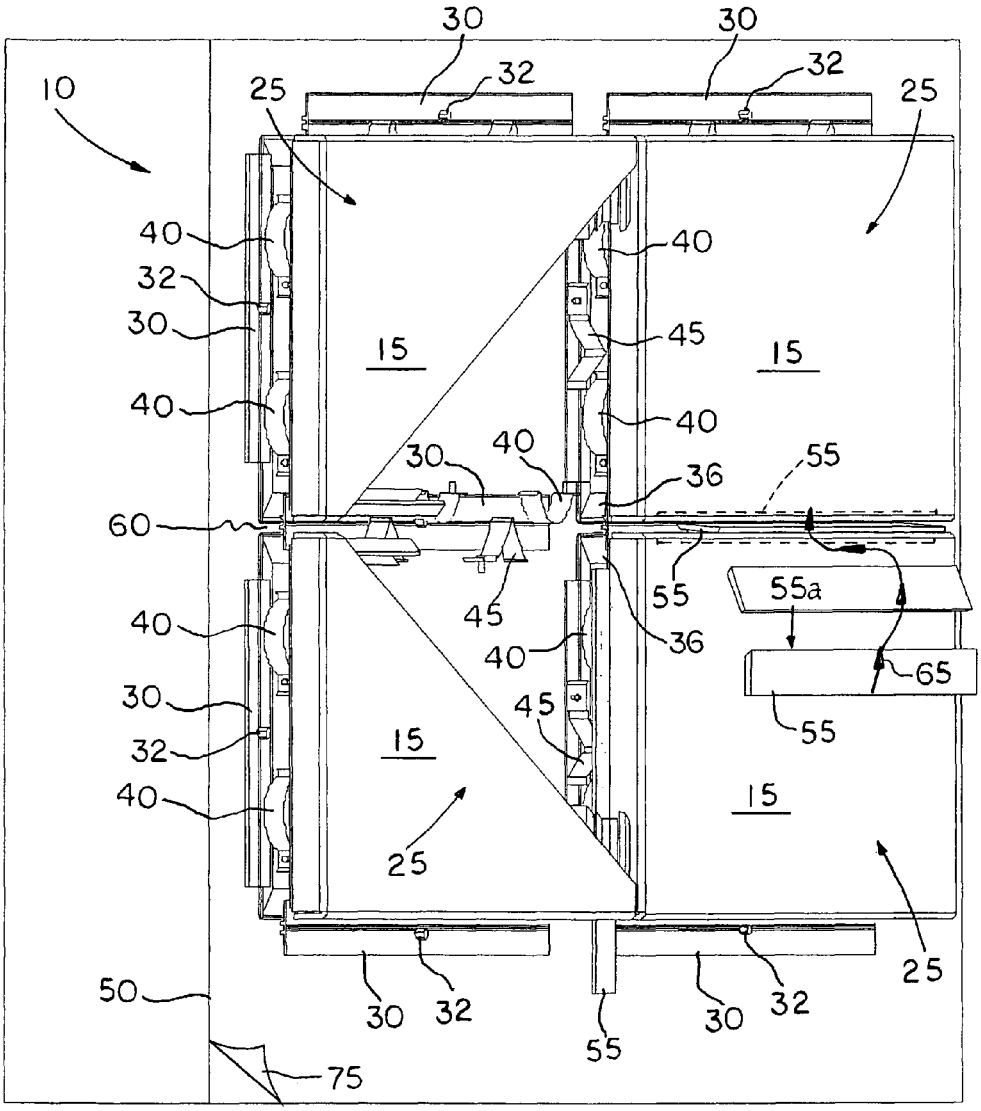
FIG. 15 is a partially cutaway composite view of an array of ACM panel assemblies of the present system showing the internal arrangement of the spring clips attached to the panel assemblies and a sequential illustration of a reveal strip installation procedure.

Referring to FIG. 15 there is shown an array of panel assemblies 25 including a plurality of spring clips 40, 45 mounted as shown on a building substructure 50 using the present system 10. Utilizing a method of the present invention a plurality of mounting brackets 30 are attached to the building substructure 50 in perpendicular relation and arranged in a grid pattern at regular intervals corresponding to the dimensions of the individual panel assemblies 25 to be installed. Each panel assembly 25 is attached to substructure 50 by engagement of the rearward facing edges of each side member 36 within each panel frame subassembly 35 with mounting brackets 30 as shown in FIG. 13.

When the desired arrangement of panel assemblies 25 is achieved, a reveal strip 55 of a predetermined length is installed in the reveal cavity as at 60 between adjoining panel assemblies as illustrated in the composite reveal strip insertion sequence shown in FIG. 15 to complete the installation. Initially, the beveled edge 55*a* of the reveal strip 55 is inserted into the reveal cavity 60 in generally perpendicular relation to the ACM panels 15 into contact with spring clips 40, 45 as shown by directional arrows 65. It will be understood that the function of the spring clips 40, 45 is initially to guide the reveal strip 55 into its installed position in the reveal cavity 60 and then to lock the reveal strip into such position.

Figure 11B:
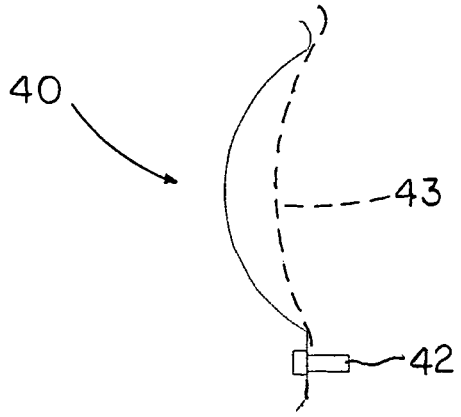
FIG. 11B is a perspective view of the curved spring clip of FIG. 11A shown in a compressed condition.
Figure 12B:
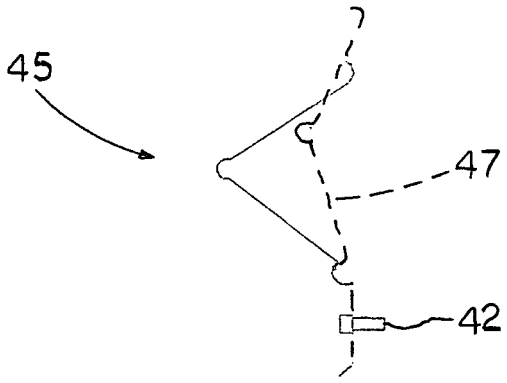
FIG. 12B is a perspective view of the angular spring clip of FIG. 12A shown in a compressed condition.

Still referring to FIG. 15 this is accomplished by pushing the reveal strip 55 inwardly against the spring bias of curved spring clips 40 to deform such clips 40 to a compressed condition (shown by broken line 43 in FIG. 11B). Next, the reveal strip 55 is partially rotated (shown by directional arrows 65 in FIG. 15) about its longitudinal axis into contact with angular spring clips 45 to deform such clips 45 to a compressed condition (shown by broken line 47 in FIG. 12B).

While maintaining manual pressure inwardly against the spring bias of angular spring clips 45 and continuing partial rotation (shown by directional arrows 65 in FIG. 15) against the spring bias of angular spring clips 45, reveal strip 55 slides past clips 45, which return to a relaxed condition and the reveal strip snaps into the position (shown broken outline in FIG. 15) wherein it is locked between side members 36 of adjoining panel assemblies 25. Reveal strips 55 function to cover the fasteners such as screws 32, which secure the underlying mounting brackets 30 to the building substructure 50.

Of course, various other configurations of spring clips 40, 45 may be devised to function in guiding the insertion and locking of the reveal strips 55 into position. The embodiments of spring clips 40, 45 disclosed herein are considered illustrative and not restrictive in any sense. Thus, various alternative designs for spring clips 40, 45 are considered within the scope of the present invention. Accordingly, other materials such as engineered plastics, rubber and coated steel having similar deformable characteristics can be utilized to fabricate spring clips 40, 45.

Although not specifically illustrated in the drawings, it should be understood that additional equipment and structural components will be provided as necessary and that all of the components described above are arranged and supported in an appropriate fashion to form a complete and operative Dry Joint Wall Cladding Attachment System and Method of Use incorporating features of the present invention.

Moreover, although illustrative embodiments of the invention have been described, latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

What is claimed is:

1. A wall cladding attachment system for attachment of panels to a building substructure, wherein the system comprises:

a plurality of panel mounting brackets for attachment to a building substructure at predetermined intervals in a grid pattern on said building substructure;

a plurality of panel assemblies configured for attachment to said mounting brackets such that the panel assemblies are disposed in coplanar relation to other panel assemblies of said plurality of panel assemblies, wherein each of the plurality of panel assemblies includes a panel and a panel frame subassembly including a plurality of side members attached to each of said panels, wherein each of said side members includes a plurality of curved spring clips attached thereto being deformable from a compressed condition to a relaxed condition, wherein each of the plurality of said panel frame subassemblies is configured for engagement with each of said plurality of panel mounting brackets; and a plurality of reveal strips for insertion into a reveal cavity formed between adjoining panel assemblies of said plurality of panel assemblies, wherein said reveal strips compress said plurality of spring clips against a spring bias upon insertion of said reveal strips into said reveal cavity thereby locking said reveal strips in position to cover said mounting brackets in an installed condition of said reveal strips and enabling non progressive removal of said reveal strips during replacement of said panel assemblies.

2. The wail cladding attachment system of claim 1 wherein said plurality of spring clips function to be alternately compressed against said spring bias and released to guide said plurality of reveal strips into position during said insertion of said reveal strips within said reveal cavity locking said reveal strips into an installed position between the adjoining panel assemblies to reduce moisture infiltration into the system.

3. The wall cladding attachment system of claim 1 wherein said panels are constructed of aluminum composite material.

4. The wall cladding attachment system of claim 1 wherein the panels are constructed of building materials selected from the group consisting of metal, wood, stone, engineered plastics and composite materials.

5. The wall cladding attachment system of claim 1 wherein said reveal strips are constructed of aluminum composite material.

6. The wall cladding attachment system of claim 1 wherein said reveal strips are constructed of building materials selected from the group consisting of metal, wood, stone, engineered plastics and composite materials.

7. The wall cladding attachment system of claim 1 wherein said spring clips are fabricated from a deformable spring biased material.

8. The wall cladding attachment system of claim 7 wherein said spring clips are fabricated from deformable materials selected from the group consisting of metal, rubber, engineered plastics and composite materials.

9. A wall cladding attachment system for attachment of panels to a building substructure, wherein the system comprises:

(a) a plurality of panel mounting brackets for attachment to a building substructure at predetermined intervals in a grid pattern on said building substructure;

(b) a plurality of panel assemblies configured for attachment to said mounting brackets such that said panel assemblies are disposed in coplanar relation to other panel assemblies of said plurality of panel assemblies, wherein each of the plurality of panel assemblies includes a panel and a panel frame subassembly including a plurality of side members attached to each of said panels, wherein each of said side members includes a plurality of curved spring clips attached thereto being deformable from a compressed condition to a relaxed condition, wherein each of the plurality of said panel frame subassemblies is configured for engagement with each of said plurality of panel mounting brackets; and (c) a plurality of reveal strips for installation in a reveal cavity between adjoining panel assemblies of said plurality of panel assemblies;

wherein each panel frame subassembly is configured for sliding engagement with said mounting brackets;

wherein each panel assembly of said plurality of panel assemblies further includes a plurality of curved spring clips disposed about the lateral edges of each panel frame subassembly, wherein said reveal strips compress said plurality of curved spring clips against a spring bias upon insertion of said reveal strips into a said reveal cavity thereby locking said reveal strips in position to cover said mounting brackets in an installed condition of said reveal strips and enabling non-progressive removal of said reveal strips during replacement of said panel assemblies.

10. The wall cladding attachment system of claim 9 wherein said plurality of spring clips function to be alternately compressed against said spring bias and released to guide said plurality of reveal strips into position during said insertion of said reveal strips within said reveal cavity locking said reveal strips into an installed position between the adjoining panel assemblies.

11. The wall cladding attachment system of claim 9 wherein each of said panels is constructed of aluminum composite material.

12. The wall cladding attachment system of claim 9 wherein the panels are constructed of building materials selected from the group consisting of metal, wood, stone, engineered plastics and composite materials.

13. The wall cladding attachment system of claim 9 wherein said spring clips are fabricated from a deformable spring biased material.

14. The wall cladding attachment system of claim 9 wherein said spring clips are fabricated from deformable materials selected from the group consisting of metal, rubber, engineered plastics and composite materials.

* * * * *